United States Patent [19]

Biloff

[11] Patent Number: 4,891,865

[45] Date of Patent: Jan. 9, 1990

[54] APPARATUS FOR SECURING AN ARTICLE IN A POCKET

[76] Inventor: Elmer E. Biloff, 18289 Thomas La., Shafter, Calif. 93263

[21] Appl. No.: 341,496

[22] Filed: Apr. 21, 1989

Related U.S. Application Data

[63] Continuation-in-part of Ser. No. 150,513, Feb. 8, 1988, abandoned, which is a continuation-in-part of Ser. No. 2,506, Jan. 12, 1987, abandoned.

[51] Int. Cl.[4] ..... A44B 21/00

[52] U.S. Cl. ..... 24/3 H; 24/3 R

[58] Field of Search ..... 24/3 R, 3 H; 116/84; 43/58; 150/134

[56] References Cited

U.S. PATENT DOCUMENTS

| | | | |
|---|---|---|---|
| 806,750 | 12/1905 | Padmore | 24/3 H |
| 1,513,784 | 11/1924 | Rosener . | |
| 1,581,645 | 4/1926 | Laporte | 150/134 |
| 2,522,606 | 9/1950 | Curry | 150/134 X |
| 2,795,023 | 6/1957 | Howell | 24/3 H |
| 2,796,106 | 6/1957 | Neuhausen | 150/134 |
| 3,003,532 | 10/1961 | Nelson | 150/134 |
| 3,144,894 | 8/1964 | Young | 24/3 H X |
| 3,297,070 | 1/1967 | Jeffers | 24/3 H |
| 4,194,271 | 3/1980 | Hamilton . | |
| 4,570,302 | 2/1986 | de Montalembert . | |

*Primary Examiner*—James R. Brittain

*Attorney, Agent, or Firm*—Lyon & Lyon

[57] ABSTRACT

An anti-pickpocket device for preventing a wallet from being removed from a pocket without the wearer's knowledge by creating a drag on the wallet. The device consists of a plurality of downwardly-projecting prongs pivotally mounted on a flat base which are urged outwardly therefrom by resilient means. An inflatable tube is mounted in the base which, upon inflation, rotates the prongs into a flat disposition with respect to the base for unimpeded withdrawal of the wallet. A small hand pump in fluid communication with the expansible tube by means of flexible tubing and a pressure relief valve are provided for selective inflation and deflation of the expansible tube for controlling the orientation of the prongs.

10 Claims, 1 Drawing Sheet

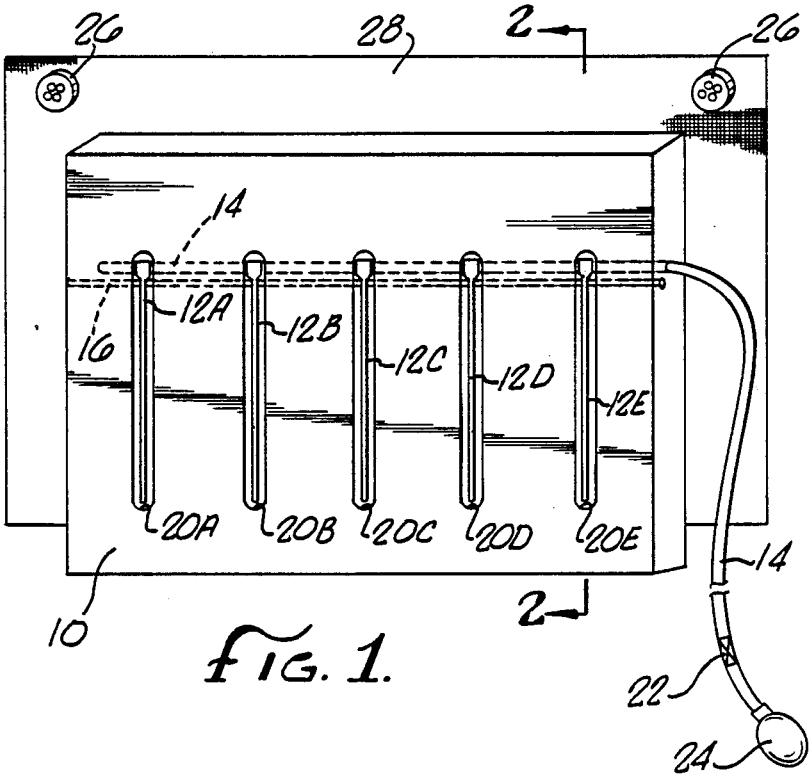
FIG. 1.
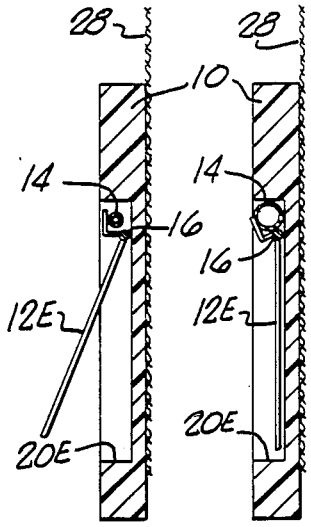
FIG2A. FIG2B.
FIG. 3.
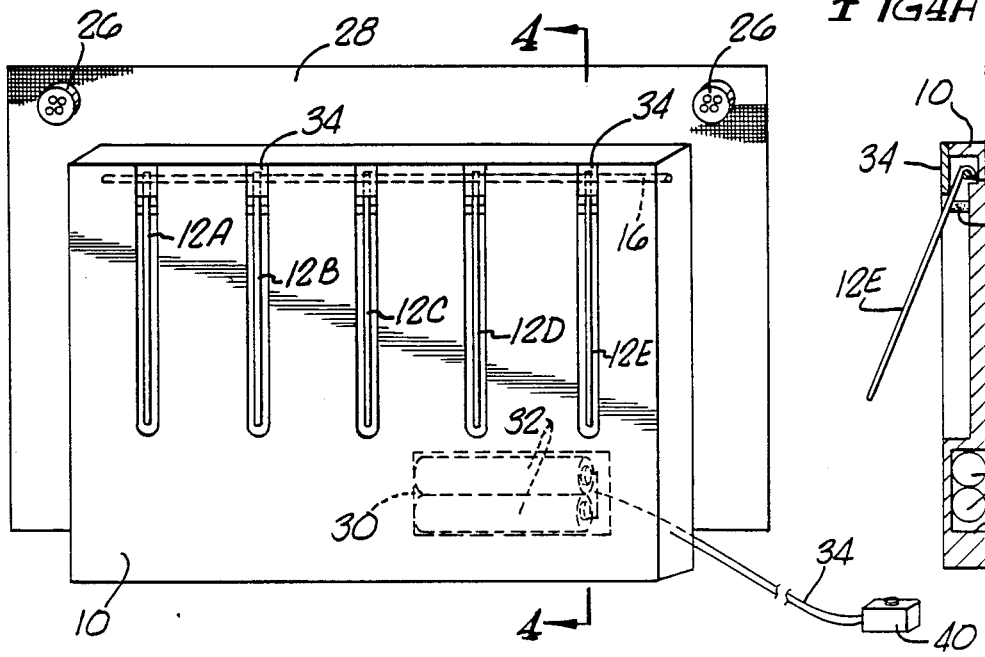
FIG4A. FIG.4B.
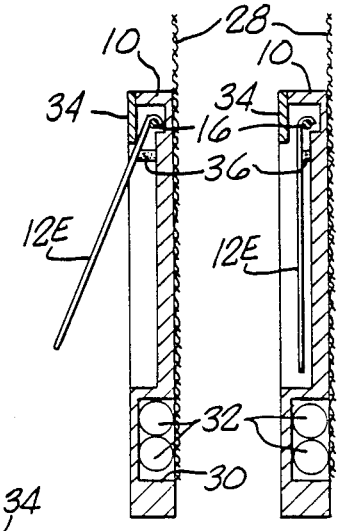

APPARATUS FOR SECURING AN ARTICLE IN A POCKET

This is a continuation-in-part of copending application Ser. No. 150,513 filed on Feb. 8, 1988, abandoned, which is a continuation-in-part of application Ser. No. 002,506 filed on Jan. 12, 1987, abandoned.

BACKGROUND OF THE INVENTION

Devices that prevent or deter pickpockets from practicing their trade are known in the art. Clips and wires with hooks that snag the pocket so that a wallet cannot be extracted therefrom are disclosed in U.S. Pat. No. 1,513,784 by Roesner, U.S. Pat. No. 2,522,606 by Curry and U.S. Pat. No. 4,570,302 by de Montalembert. However, all these devices are problematic in that they either cause distortion of the pocket in which they are contained, snag the fabric of the pocket in order to inhibit removal of the wallet, or use sharp hooks that are capable of causing physical injury.

SUMMARY OF THE INVENTION

The present invention is directed toward an anti-pickpocket device that will not snag or tear clothing but will still secure the wallet inside the pocket should someone attempt to extract the wallet without the wearer's knowledge or consent. The device includes a plurality of retractable prongs mounted on a base attached to the pocket such that the prongs extend downwardly into the pocket and, though they allow the wallet to be inserted with ease, they resist removal of the wallet by extending downwardly and slightly outwardly against the wallet thereby preventing its unknowing removal. A remotely operated switch allows the wearer to retract the prongs into the base, thereby allowing the wallet to be easily removed when the wearer so desires. The switch can be carried in the front pants pocket of the wearer, or any location on the wearer's person that facilitates the user's access.

BRIEF DESCRIPTION OF THE DRAWINGS

FIG. 1 is a sectional side view of the invention taken along line 1—1 of FIG. 3 illustrating the prongs in the retracted position;

FIG. 2 is a sectional side view of the invention illustrating the prongs in the extended position;

FIG. 3 is a rear view of the invention with the prongs (in phantom) in the retracted position;

FIG. 4A is a side view of a prong of the present invention;

FIG. 4B is a front view of a prong of the present invention; and

FIG. 5 is a sectional view taken along line 5—5 of FIG. 3.

DETAILED DESCRIPTION OF THE PREFERRED EMBODIMENT

Referring now in detail to the drawings, the anti-pickpocket device 10 includes a rectangular base 12 and a plurality of prongs 13 pivotally mounted on a fixed rod 14. Rod 14 is mounted within base 12 such that it traverses a transverse channel 16 in the upper portion of base 12 with the extended ends of rod 14 being secured in the side or end walls 18 of channel 16. Alternatively, rod 14 could be comprised of a plurality of individual shorter rods or pins corresponding in number to the number of prongs 13, and the transverse dimension of channel 16 could be reduced so as to hold each of the shorter rods in place in a press fit within the narrower channel. Each prong 13 would then pivot about a single stationery rod as opposed to all of the prongs pivoting about rod 14 as shown.

The prongs 13 are preferably of single-piece construction, formed of a relatively rigid plastic material and each define a lower elongated downwardly projection portion 20, an intermediary inclined portion 22 extending upwardly and inwardly from portion 20, a first upstanding portion 24 extending substantially parallel to lower portion 20, a horizontal portion 26 and a second upstanding portion 28 extending upwardly from the forward end of horizontal portion 26 substantially parallel to portions 20 and 24. The prongs are pivotally secured to rod 14 at equally spaced intervals therealong at the juncture between the intermediary portions 22 and the first upstanding portions 24.

Base 12 defines a corresponding plurality of slots 30 in the front side 32 of the base to receive the lower elongated portions 20 of prongs 13 when the prongs are in the retracted position illustrated in FIG. 1. Slots 30 communicate with channel 16 and preferably define inwardly tapered bottom walls 33. A plurality of biasing means such as a coil springs 34 are provided for urging the prongs outwardly to the position illustrated in FIG. 2. Each of springs 34 are positioned in inclined receiving slots 34 in base 12 such that the springs project into the channel 16 and bear against the prongs 13, causing the prongs to pivot counterclockwise about rod 14 to the position illustrated in FIG. 2. A projection 36 is provided on the rearward side of each prong 13 which extends into the aligned spring 34 to hold the spring in place. A depending wall portion 38 extending over the upper forward portion of channel 16 in the base 12 defines a stop 40 for limiting the outward extension of the prongs from the base as illustrated in FIG. 2.

An inflatable tube 42 having a closed end is disposed in the upper end of channel 16 and extends thereacross above and parallel to rod 14. Tube 42 is held between the upper end wall 44 of channel 26, rear wall 43 thereof, and the upper "L"-shaped portions of the prongs defined by horizontal portions 26 and second upstanding portions 28. A small, preferably rigid air conduit 46 communicates the interior of tube 42 with an inflating bulb 49 via flexible tube 54. Conduit 46 is secured to the base 12 by anchors 48 and one end 50 thereof extends beyond the side wall 52 of base 12 where conduit 46 is in fluid communication with a flexible tube 54. Flexible tube 54 has sufficient length so that the open end 56 thereof can extend from the rear pocket of the wearer of the device through the belt hoops and, for example, into the front pant pocket of the wearer.

At the extended end 56 of the flexible tube 54 there is provided a one-way valve 60 and the small inflating bulb 49. By repeatedly squeezing bulb 49, air is drawn into the bulb through air inlet 62 and forced therefrom through the outlet 64 in the bulb 49, through valve 60, flexible tube 54 and into conduit 46, thereby inflating tube 42 as shown in FIG. 1. As valve 60 is unidirectional, it only allows air to flow therethrough in the direction from the bulb 49 into the flexible conduit 54. A conventional pressure relief mechanism 66 is provided in valve 60 so that the air can be released from the inflated tube 42, causing the tube to deflate.

The base 12 of the anti-pickpocket device 10 is constructed so that the flexible tube 54 may attach to either side. The anti-pickpocket device can be fastened to the user's pants pocket by gluing or otherwise affixing a strip 70 of a hook and pile fastener to the rear portion of the base 12 and sewing another strip of a hook and pile fastener 72 to the pocket wall. The device is thereby removably fixed in the user's pocket. A cover plate 74 is provided on the rear side of the upper portion of the base 12 and is removably attached by screws 76. Cover plate 74 allows access to the working portions of the device, so that they can be inserted, repaired or removed with ease and also provides the rear wall support for the inflatable tube 46.

To retain the prongs 13 in the retracted position, a sliding gate 78 can be provided which defines a plurality of upstanding projections 80 therein. Gate 78 is slidably mounted within a channel 82 in base 12. As seen in FIGS. 3 and 4, Channel 82 defines recessed areas 84 which are disposed over and adjacent the extended ends of prongs 13 so that as gate 78 is slid back and forth across base 12, each of projections 80 will collectively abut either end walls 86 or 88 of recessed areas 84. When the projections 80 abut end walls 86, the projections are collectively disposed over the ends of prongs 13, securing the prongs within the slots 30 in base 12. Alternatively, when the projections 80 collectively abut end walls 88 of recessed areas 84, the projections 80 are disposed out of the paths of the prongs 13, allowing the prongs to move outwardly from base 12 under the force of springs 34. To facilitate operation of gate 78, the gate is longer than base 12 so that one end of the gate always protrudes from one side of base 12, allowing the gate 78 to be easily slid to its desired disposition. To retain the gate 78 within channel 82 without the need for an additional cover plate, the gate 78 and channel 82 can be configured such that they form a "Z" configuration adjacent each end of the base 12 as seen in FIG. 5. Thus the channel 82 is open along the front side 32 of the base from point 90 to 92, angles rearwardly at 93 and 95 and is then open adjacent its ends on the rearside of the base to the ends of the base. Gate 78 is correspondingly configured to fit within and slide back and forth within the channel, its range of movement restricted by the contact of upstanding projections 80 with the walls 86 and 88 of recessed areas 84 of channel 82 and the abutment of the forwardly projecting ends of the gate 78 at 90 and 92.

In use, the prongs 13 are normally forced to the extended position by springs 34. The user merely presses the prongs 13 inwardly and inserts the device 10 in his or her pocket and secures the device in place over the wallet by means of the hook and pile attachment. If a gate 78 is employed, the prongs can be collectively released by the gate after the device has been secured in the user's pocket. Upon releasing the prongs, the coil springs 34 will cause the prongs to undergo counterclockwise pivotal rotation whereupon the prongs will bear against the user's wallet. To prevent scratching the wallet, the prongs 13 are formed of plastic and do not define an overly sharp edge at their extended ends. A flap or rib of material (not shown) is attached to the user's wallet, preferably adjacent the lower edge thereof, which will be engaged by the prongs in their projecting position and prevent easy withdrawal of the wallet from the pocket.

To retrieve the wallet, the user merely squeezes bulb 49, causing the tube 42 to inflate. As tube 42 inflates, it bears against the rear wall 43 of channel 16 defined by the interior surface of cover plate 74, the upper end wall 44 of base 12, and the horizontal portions 26 and upstanding portion 28 of prongs 13. Continued pressure against the surfaces 28 of the prongs 13 causes clockwise rotation of the prong 13 about rod 14, retracting the lower projecting portions 20 of the prongs. The wallet can then be easily removed from the pocket without interference by the prongs. Upon reinserting the wallet into the pocket, the pressure relief mechanism 66 on valve 60 is activated to relieve the pressure in tube 42, whereupon the tube quickly deflates and the prongs return to their extended position under the force of spring 34.

Various changes and modifications may be made in carrying out the present invention without departing from the spirit and scope thereof. Insofar as these changes and modifications are within the purview of the appended claims, they are to be considered as part of the invention.

I claim:

1. An anti-pickpocket device to be worn in a pocket comprising:

a base member;

prong support means carried by said base member;

a plurality of prongs pivotally mounted on said support means;

biasing means carried by said base member for urging said prongs to a first position;

inflatable means carried by said base member for pivoting said prongs about said support means from said first position to a second position; and means for inflating said inflatable means, said means for inflating being disposed exteriorly of said base member and being capable of being operated at a location remote from said base member.

2. The anti-pickpocket device of claim 1 wherein said inflatable means comprises an elongated expansible tube carried by said base member such that upon the inflating means inflating said tube, said tube bears against portions of said prongs causing said prongs to pivot about said support means from said first position to said second position.

3. The anti-pickpocket device of claim 2 wherein said support means comprises a rod extending substantially the length of said base member and wherein each of said prongs define an upstanding portion adjacent the upper end thereof adapted to be contacted and urged forwardly by said tube upon said tube being inflated thereby causing the prongs to pivot from said first position to said second position.

4. The anti-pickpocket device as in claims 1, 2 or 3 wherein the prongs are made of a non-resilient material.

5. The anti-pickpocket device as in claims 2 or 3, wherein the means for inflating the inflatable means comprises: a first length of tubing carried by said base and communicating with said expansible tube, a pump means, a second length of tubing of a flexible material communicating said first length of tubing with said pump means, valve means operatively connected between said pump means and said first length of tubing for allowing fluid to pass from said pump means to said first length of tubing while preventing flow therethrough in the opposite direction, and pressure release means for selectively allowing fluid flow outwardly of said expansible tube whereupon said prongs are urged by said spring members from said second position to said first position.

6. The anti-pickpocket device as in claims 1, 2 or 3 wherein at least portions of said prongs project outwardly and downwardly from said base member in said first position and are recessed within said base member in said second position and including a stop member carried by said base member for limiting the outward projection of said prongs in said first position.

7. The anti-pickpocket device of claim 6, including means for securing said device in a pants pocket, said means for securing comprising a hook and pile fastener, one portion of said fastener being secured to said base member on the opposite side thereof from which said prongs project in said first position, the mating portion thereof being adapted to be secured in the pants pocket.

8. The anti-pickpocket device as in claims 2 or 3 wherein each of said prongs defines an "L"-shaped upper end and an elongated lower end, said "L"-shaped upper end being adapted to be abutted by said expansible tube upon said tube being inflated by said inflating means for effecting pivotal movement of said prongs from said first position to said second position and the elongated lower end being adapted to abut an object in a pocket when in said first position to restrict removal thereof from the pocket.

9. An anti-pickpocket device to be worn in a pocket for engaging a flap or ridge on a wallet to prevent unauthorized easy withdrawal of the wallet from the pocket, said device comprising:

a base member;

prong support means carried by said base member;

a plurality of prongs pivotally mounted on said support means;

biasing means carried by said base member for urging said prongs to a first position;

inflatable means carried by said base member for pivoting said prongs about said support means from said first position to a second position, a pump means disposed exteriorly of said base member for inflating said inflatable means;

means for communicating said pump means with said inflatable means; and a locking gate member slidably mounted in said base member, said gate member defining a plurality of projections adapted to be collectively disposed over portions of said prongs or adjacent thereto for selectively retaining said prongs in said first position.

10. The anti-pickpocket device of claim 9 wherein each of said prongs defines an "L"-shaped upper end and an elongated lower end, said "L"-shaped upper end being adapted to be abutted by said inflatable means upon said inflatable means being inflated by said pump means for effecting pivotal movement of said prongs from said first position to said second position and the elongated lower end being adapted to abut an object in a pocket when in said first position to restrict removal thereof from the pocket.

* * * * *